US005915766A

United States Patent [19]

Baumeister et al.

[11] Patent Number: 5,915,766

[45] Date of Patent: Jun. 29, 1999

[54] LOCKING DEVICE

[75] Inventors: Karl-Heinz Baumeister, Balingen-Ostdorf; Dietmar Kopp, Einbeck; Thomas Ballhause, Herzberg; Michael Umbach, Badenhausen, all of Germany

[73] Assignee: Kendro Laboratory Products GmbH, Hanau, Germany

[21] Appl. No.: 08/895,654

[22] Filed: Jul. 17, 1997

[30] Foreign Application Priority Data

Jul. 20, 1996 [DE] Germany ..... 196 29 361

[51] Int. Cl.[6] ..... E05B 15/02

[52] U.S. Cl. ..... 292/341.15; 292/201; 292/27; 292/49; 292/53; 292/DIG. 25; 70/279; 70/256

[58] Field of Search ..... 292/98, 215, 197, 292/199, 201, 11, 27, 341.15, 49, 53, DIG. 25, 50; 70/279, 256, 257, 465

[56] References Cited

U.S. PATENT DOCUMENTS

| | | | |
|---|---|---|---|
| 1,264,814 | 4/1918 | Kornstein | 292/27 |
| 2,668,070 | 2/1954 | Schmitt | 292/27 |
| 3,532,373 | 10/1970 | Poe | 292/53 |
| 3,561,802 | 2/1971 | Brockway | 292/49 |
| 3,857,594 | 12/1974 | Pastva, Jr. | 292/27 |
| 3,893,723 | 7/1975 | Boule | 292/140 |
| 3,933,330 | 1/1976 | Gwin | 248/371 |
| 4,135,377 | 1/1979 | Kleefeldt et al. | 70/264 |
| 4,708,378 | 11/1987 | Ingenhoven | 292/201 |
| 4,978,153 | 12/1990 | Hirsch et al. | 292/201 |
| 5,012,794 | 5/1991 | Faurel | 126/197 |
| 5,072,973 | 12/1991 | Gudgel et al. | 292/55 |
| 5,209,530 | 5/1993 | Kolloch | 292/27 |
| 5,240,296 | 8/1993 | Kobayashi | 292/201 |
| 5,441,315 | 8/1995 | Kleefeldt et al. | 292/201 |
| 5,531,086 | 7/1996 | Bryant | 70/279 |
| 5,628,535 | 5/1997 | Buscher et al. | 292/201 |
| 5,639,130 | 6/1997 | Rogers, Jr. et al. | 292/216 |
| 5,738,393 | 4/1998 | Chao | 292/216 |

FOREIGN PATENT DOCUMENTS

| | | | |
|---|---|---|---|
| 41578 | 3/1910 | Austria | 292/49 |
| 0 283 043 | 9/1988 | European Pat. Off. . | |
| 0470428 | 2/1992 | European Pat. Off. . | |
| 0577863 | 10/1996 | European Pat. Off. . | |
| 94 17 388 | of 0000 | Germany . | |
| 2816395 | 10/1979 | Germany . | |
| 3821840 | 10/1989 | Germany . | |
| 4407912 | 8/1995 | Germany . | |

*Primary Examiner*—Darnell M. Boucher
*Assistant Examiner*—Clifford B Vaterlaus
*Attorney, Agent, or Firm*—Workman, Nydegger & Seeley

[57] ABSTRACT

Locking devices for locking two components that move relative to one another such as a housing and a cover are disclosed. The locking devices have two catches disposed on one component and opposite to one another and symmetrically with respect to a stop disposed on the second component and arranged in a plane of symmetry between the opposing catches. The catches have hook ends facing the plane of symmetry and the two catches are connected to a common shaft at the ends of the catches facing away from the hook ends. The common shaft is disposed in the plane of symmetry and is movable within the plane of symmetry toward and away from the stop. The shaft is arranged on a spindle disposed in the plane of symmetry or parallel to the plane of symmetry and engaged with a motor-driven gear to effect movement of the shaft. The catches have longitudinally-extending guide elements whose longitudinal axis does not run parallel to the plane of symmetry. The guide elements engage stationary guide pins disposed parallel and symmetrically with respect to the plane of symmetry. This arrangement provides the guidance of the catches when the shaft is moved toward and away from the stop. When the shaft is at rest in a position nearest to the stop, the hook ends of the catches are opposed across the plane of symmetry. When the shaft is moved downwardly away from the stop, the hook ends of the catches move into the plane of symmetry, without lateral forces, to close around the stop from two opposing sides. This ensures equal stress on the closed lock from all sides, even under high stress and, particularly, high lateral stresses placed upon the locked-together components.

11 Claims, 2 Drawing Sheets

LOCKING DEVICE

BACKGROUND OF THE INVENTION

1. The Field of the Invention

The invention relates to a locking device for locking two components that move relative to one another such as a housing and a cover. In particular, the present invention relates to a locking device that operates by means of a catch disposed on one component and having at least one hook end that can extend around a stop disposed on the other component for the purpose of locking the components together.

2. Related Applications

Foreign priority benefits under Section 119 of Title 35 of the United States Code of German Utility Model Application No. 196 29 361.8, filed Jul. 20, 1996, incorporated herein by reference, are claimed for this application.

3. The Relevant Technology

Numerous types of locking devices for locking two components that move relative to one another by means of a catch disposed on one component that engages a stop disposed on the other component are known. For example, a cover-locking mechanism for a centrifuge is known from German patent application DE 28 16 395 A1 in which a catch extends around a stop that is held against the catch by a coil spring. In this lock design, lateral forces occur that can cause the components that are to be locked together to pull and detach from one another, particularly components subjected to high stress such as centrifuge components. The described lock is not positively guided to the stop without lateral force. The locking is dependent on the movability of the two interlocking parts; if one of the movable parts jam, the lock is not effective. Similar locks are known from EP 0 577 863 A1. A particularly costly locking achieved via linear movement of a closing cylinder is known from EP 470 428 B1. There is no lateral force-free positive guidance in the lock published herein.

Additionally, manual locking mechanisms are generally known for centrifuges or other apparatuses in which a cover must be held securely to a housing. These types of locks are generally difficult to operate in mid-volume to high-volume centrifuges, and require relatively high sealing force.

From DE 38 21 840 C1, a locking mechanism is known for a laboratory device in which an additional locking and opening element is attached to the locking mechanism embodied as the catch to achieve secure closure. DE 44 07 912 A1 discloses a lock that is driven by an electric motor, in which the bolt is halted by two stops. The two stops lie opposite one another, are disposed symmetrically with respect to the axis of symmetry of the bolt, and have a common axis of rotation.

SUMMARY AND OBJECTS OF THE INVENTION

It is a primary object of the present invention to provide a lock for locking two components that move relative to one another by means of a catch disposed on one component that engages a stop disposed on the other component that ensures a high locking reliability, even when the components are subjected to high stress, and that is easily and securely locked with the application of low manual closing forces.

These and other objects and features of the present invention will become more fully apparent from the following description and appended claims, or may be learned by the practice of the invention as set forth hereinafter.

In accord with the present invention, the primary object is accomplished with a locking device having two catches disposed opposite to one another and symmetrically with respect to a stop arranged in a plane of symmetry between the opposing catches. The catches have hook ends facing the plane of symmetry and the two catches are connected to a common shaft at the ends of the catches facing away from the hook ends. The common shaft is disposed in the plane of symmetry and is movable within the plane of symmetry toward and away from the stop. The stop can usefully be designed as an extending hook having a closed end or as an extending hook having an end closed by a locking pin. The stop is disposed in the plane of symmetry such that the eye of the extending hook is disposed generally between the opposed catches and the closed end of the hook or the locking pin closing the end of the hook is disposed in the plane of symmetry parallel to the longitudinal axis of the shaft.

The catches have longitudinally-extending guide elements whose longitudinal axis does not run parallel to the plane of symmetry. The guide elements engage stationary guide pins disposed parallel and symmetrically with respect to the plane of symmetry. This arrangement provides the guidance of the catches when the shaft connecting the catches to one another is moved toward and away from the stop. When the shaft is at rest in a position nearest to the stop, the hook ends of the catches are opposed across the plane of symmetry. When the shaft is moved downwardly away from the stop, the hook ends of the catches move into the plane of symmetry, without lateral forces, to enter the extending hook and close around the closed end of the hook (or the locking pin closing the end of the hook) on the stop from two opposing sides. This ensures equal stress on the closed lock from all sides, even under high stress and, particularly, high lateral stresses placed upon the locked-together components.

In a preferred embodiment, the shaft is arranged on a spindle disposed in the plane of symmetry or parallel to the plane of symmetry, with the help of which spindle the shaft can be moved toward and away from the stop to thereby effect opening and closing, respectively, of the locking device. In addition, the spindle preferably engages a gear connected to a motor, which gear effects movement of the spindle. To move the shaft with the aid of the spindle, the spindle can either be connected permanently to the shaft and be movable in the direction of the spindle axis, for example by means of a worm pinion in the gear, e.g., by a rotating spindle nut seated in the gear, or the spindle can move about its spindle axis and engage a thread of the shaft. In the latter variation, only the spindle rotates, that the spindle is screwed into or out of the shaft, thus causing the shaft to move.

It is preferred to configure the catches to be essentially plate-shaped and disposed perpendicular to the plane of symmetry. It is also preferred to configure the guide elements as slots that are disposed in the catches in curved form with respect to the plane of symmetry. In a preferred embodiment, the hook ends of the catches are disposed in planes one behind the other with respect to the longitudinal axis of the shaft within the plane of symmetry so that the hook ends do not meet each other in the plane of symmetry but, rather, each hook end can be extended through the plane of symmetry, one behind the other, when entering the extending hook and closing around the stop from two opposing sides, without lateral force, thereby increasing the reliability of the lock. It is also preferable that the hook ends rest in frictional connection against the stop when the lock is in a closed state, with the stop being acted upon by a force in the direction of the shaft. This means that the spindle causes the shaft to move away from the stop not only far enough to cause the two catches to extend around the stop, but even farther so that the hook ends draw the stop in the direction of the self-locking spindle. In this manner, the component that the stop is mounted upon is pulled toward the component having the catches mounted thereon. This ensures not only a secure, but also a tight, closure between the two components, for example a housing and a cover.

In addition, in a preferred embodiment of the present invention, the gear is in a housing that is seated to be movable in the direction of the spindle axis, and a lever connected to the gear housing is disposed approximately perpendicular to the plane of symmetry and is engaged with a detent pawl, which is disposed to be movable with respect to the lever and, with the lever, stops the gear housing. When detaching the detent pawl from the lever, it is possible to move the gear manually with the spindle so that the lock can be released manually. If the motor operating the spindle loses power, for example, it is thus possible to open the lock manually. To this end, it is preferred that the detent pawl be rotatably seated and provided with a release cord so that the pawl can be pulled away from the lever by pulling the release cord.

In an exemplary embodiment of the present invention, the catches are disposed on a centrifuge housing and the stop is disposed on a centrifuge cover. The locking device of the present invention provides reliable and secure locking of a centrifuge even under the high stresses commonly generated during centrifuge use. Although the locking device of the present invention is very well suited for use with a centrifuge, the description of the locking device in connection with a centrifuge is illustrative only and not to be construed as limiting.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
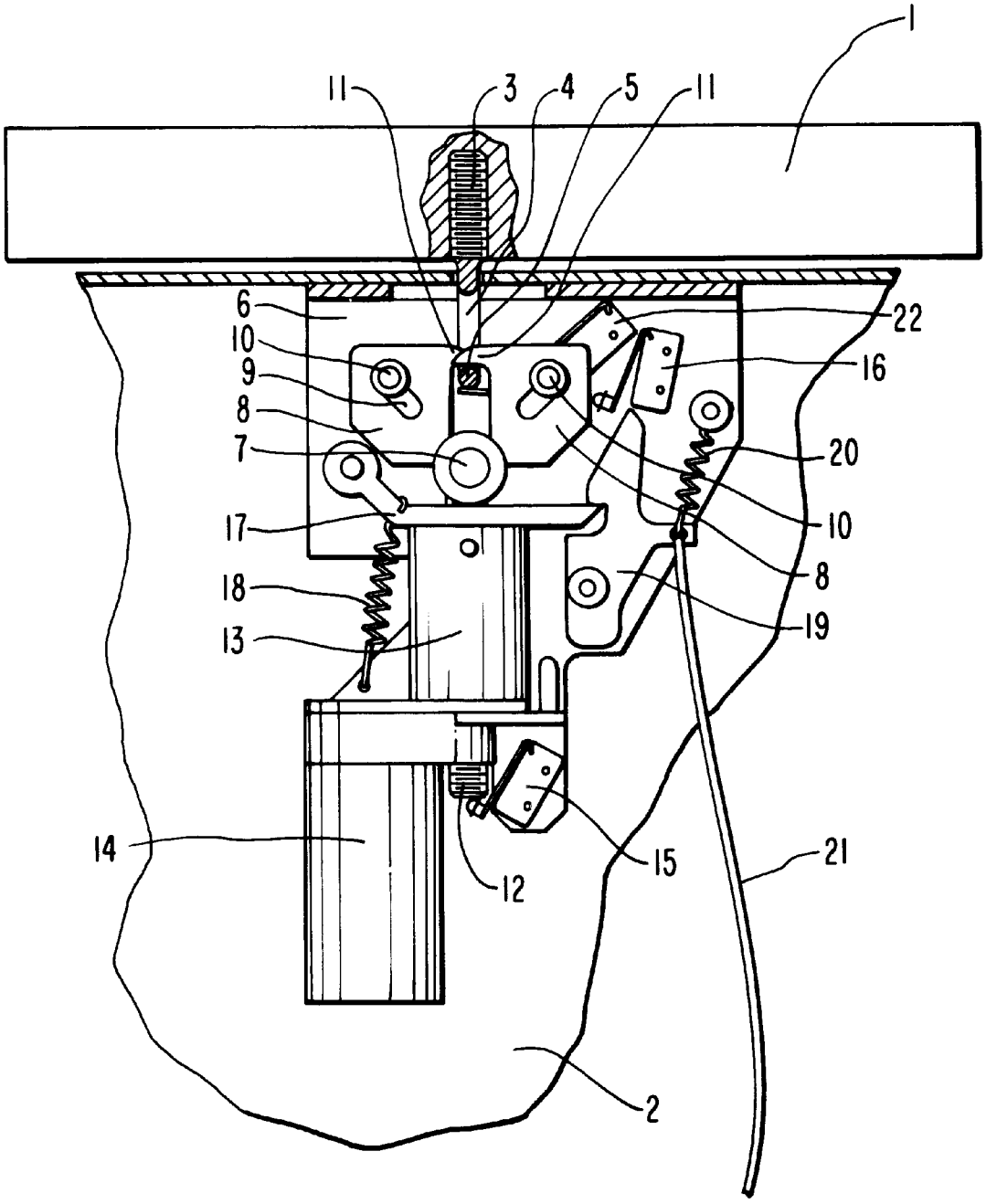
FIG. 1 is a vertical cross-section of a locking device in accord with the present invention in the locked (closed) position.

The drawings illustrate vertical cross-sections of a preferred embodiment of the locking device of the present invention with respect to a cover 1 for a housing 2. Cover 1 and housing 2 can be, for example, components of a laboratory centrifuge. The locking device of the present invention provides reliable and secure locking of a centrifuge even under the high stresses commonly generated during centrifuge use. Although the locking device of the present invention is very well suited for use with a centrifuge, the description of the locking device in connection with a centrifuge is illustrative only and not to be construed as limiting.

Returning to the Figures, a stop 3 is disposed on cover 1, the stop having an extending hook 4 (only one side of extending hook is visible in vertical cross-section view) that projects downward into the housing 2 when the cover 1 is closed upon the housing 2. The extending hook can be closed at the bottom end or, preferably, as shown in the Figures, has a bottom end closed by a locking pin 5 (seen in cross-section). An apron 6 is disposed within the housing 2 for mounting of various components of the locking device. Stop 3, comprising extending hook 4 and locking pin 5, lies upon a plane of symmetry that extends perpendicular to apron 6. Extending outward from apron 6, shaft 7 stands in this plane of symmetry below locking pin 5 such that the longitudinal axis of shaft 7 is parallel to locking pin 5. Shaft 7 is supported on spindle 12 to be movable in the plane of symmetry up and down, i.e., toward and away from locking pin 5, as described in detail below.

Two catches 8, disposed on opposite sides of the plane of symmetry, are connected to shaft 7 and disposed to be movable symmetrically with respect to the plane of symmetry. The stop 3 is disposed in the plane of symmetry such that the eye of the extending hook 4 is disposed generally between the opposed catches 8 when the cover 1 is closed upon the housing 2. Catches 8 are preferably plate-shaped and have hook ends 11 at the ends opposite to the shaft 7. Each catch 8 has a guide slot 9 that is angled with respect to the plane of symmetry.

As seen in FIG. 1, when the lock is closed, the angle of each guide slot is preferably about 45° with respect to the plane of symmetry when an extension of the longitudinal axis of each slot intersects the center of shaft 7. Stationary guide pins 10 are rigidly connected to extend from apron 6 to engage guide slots 9. It is preferred to configure the catches to be essentially plate-shaped and disposed perpendicular to the plane of symmetry. It is also preferred to configure the guide elements as slots that are disposed in the catches in curved form with respect to the plane of symmetry and to arrange the guide pins parallel and symmetrically with respect to the plane of symmetry. This arrangement provides the guidance of the catches when the shaft connecting the catches to one another is moved toward and away from the stop. When the shaft is at rest in a position nearest to the stop (FIG. 2), the hook ends of the catches are opposed across the plane of symmetry. When the shaft is moved downwardly away from the stop (FIG. 1), the hook ends of the catches move into the plane of symmetry, without lateral forces, to enter the extending hook and close around the locking pin from two opposing sides. This ensures equal stress on the closed lock from all sides, even under high stress and, particularly, high lateral stresses placed upon the locked-together components.

As seen in FIG. 1, when the locking device is closed, the hook ends 11 of the catches 8 are positioned within the plane of symmetry to enter extending hook 4 and rest on locking pin 5. In a preferred embodiment, the hook ends of the catches are disposed in planes one behind the other with respect to the longitudinal axis of the shaft 7 in the plane of symmetry so that the hook ends do not meet each other in the plane of symmetry but, rather, each hook end 11 can be extended through the plane of symmetry, one behind the other, when entering the extending hook 4 and closing around the stop 3 from two opposing sides, without lateral force, thereby increasing the reliability of the lock. It is also preferable that the hook ends 11 rest in frictional connection against the locking pin 5 when the lock is in a closed state such that the stop is being acted upon by a force in the direction of the shaft. A downward force acting upon locking pin 5 causes the cover 1 to be pulled tightly down onto housing 2. The downward pulling force is effected by spindle 12 that is pulled downward by a gear 13 by means of a motor 14.

In a preferred embodiment, the shaft is arranged on a spindle disposed in the plane of symmetry or parallel to the plane of symmetry, with the help of which spindle the shaft can be moved toward and away from the stop to thereby effect opening and closing, respectively, of the locking device. To move the shaft with the aid of the spindle, the spindle can either be connected permanently to the shaft and be movable in the direction of the spindle axis, for example by means of a worm pinion in the gear, e.g., by a rotating spindle nut seated in the gear, or the spindle can move about its spindle axis and engage a thread of the shaft. In the latter variation, only the spindle rotates, so that the spindle is screwed into or out of the shaft, thus causing the shaft to move.

As described above, when motor 14 rotates, spindle 12 is moved upward or downward by gear 13 so that the lock is opened or closed. When moving downward, i.e., when closing the lock, the spindle 12 is not merely moved downward far enough so that the hook ends 11 rest against locking pin 5 but, instead, the movement progresses slightly further a few millimeters so that cover 1 is drawn tightly and securely onto housing 2 by catches 8. As seen in FIG. 1, in its lower, final position, spindle 12 preferably activates a final-position switch 15 which terminates the closing procedure via control electronics of motor 14. Additionally, if desired, final-position switch 15 can also perform an emergency-release function through a mechanical coupling (not shown) to detent pawl 19, described in more detail below. In a preferred embodiment, the state of the lock (open or closed) is indicated by switches 16 and 22 or, indirectly, by final-position switch 15 in connection with switches 16 and 22. Switch 22 switches motor 14 on and off via control electronics of a known type. In a preferred embodiment, a final-position switch is disposed below the spindle axis for detecting the spindle position. This final-position switch can be used to indicate the lock status. The switch can be used to signal the motor to stop when the spindle is in the final-position. Furthermore, a position indicator is preferably provided to indicate the position of the catches.

Figure 2:
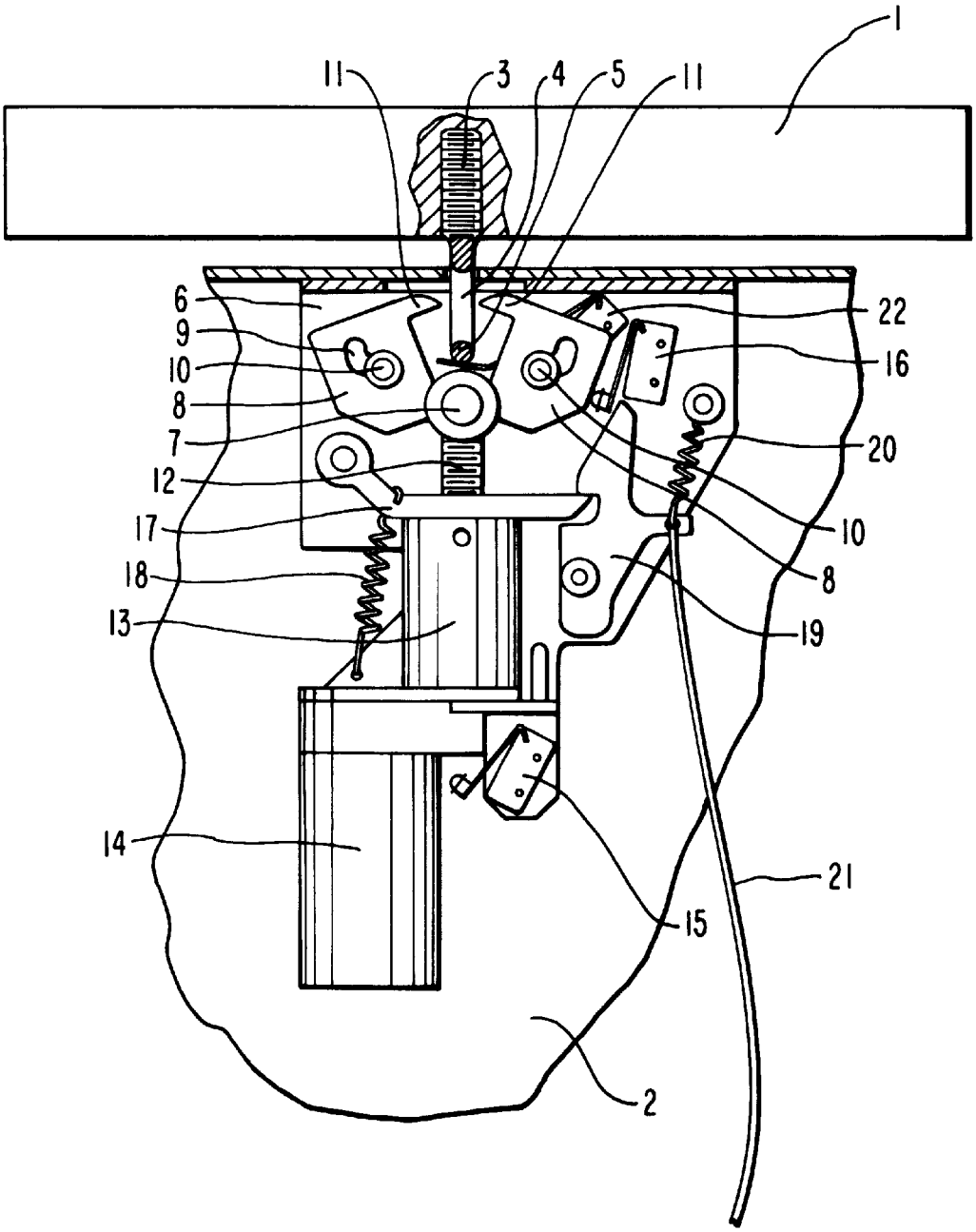
FIG. 2 is a vertical cross-section of a locking device in accord with the present invention in the unlocked (open) position.

As seen in FIG. 2, the locking device is opened by driving spindle 12 upward using motor 14 and gear 13. In this manner, shaft 7 is pushed upward and, in turn, shaft 7 moves catches 8. The catches 8 do not move directly vertically but, due to positive guidance provided by guide slots 9 moving along stationary guide pins 10, move away from the plane of symmetry causing the hook ends 11 to be angled upwardly and guided out of the extending hook 4 such that the stop 3 is released and cover 1 can be opened.

It is, of course, conceivable to exchange positions of the catches and stops with one another, in which case, for example, instead of the stop, a catch having two hook ends is disposed in the plane of symmetry, and two stops that are movable about the shaft are shifted into and out of engagement with the catch hook ends due to the positive guidance when the shaft is moved relative to the catch. Here, too, the symmetrical movement ensures equal distribution of forces and thus secure closing. Likewise, it is possible to exchange the positions of the longitudinally-extending guide elements with the guide pins (pins in the catch engaged with stationary guide elements).

In addition, in a preferred embodiment of the present invention, the unit comprising gear 13 and motor 14 is seated to be movable with respect to the apron 6 in the direction of the spindle axis. Normally, the unit comprising gear 13 and motor 14 is stopped from moving with respect to apron 6 by a lever 17 rotatably seated on apron 6 adjacent to gear 13 and disposed approximately perpendicular to the plane of symmetry. Lever 17 is drawn downward by means of a spring 18 and latched in a recess of detent pawl 19. When lever 17 is detached from the detent pawl 19, it is possible to manually move the gear with the spindle so that the lock can be released manually. The lock must be able to be opened, if necessary, even in a powerless state preventing spindle 12 from being driven upward by motor 14. To this end, it is preferred that the detent pawl 19 be rotatably seated and held in the operating position by spring 20. Release cord 21 is attached to detent pawl 19 such that a counter force to spring 20 is produced by pulling on release cord 21. Lever 17 is not permanently connected to the motor-gear unit. Thus, release of detent pawl 19, in turn, unlatches lever 17 so that the unit comprising the motor 14, gear 13, spindle 12 and shaft 7 is no longer stopped by lever 17. If desired, the position query for detent pawl 19 can be effected by an additional switch (not shown) as well as through a mechanical coupling (not shown) to final-position switch 15.

During emergency unlatching, a relative movement occurs between lever 17 and motor 14 and gear 13. Cover 1 can be manually raised causing shaft 7 and, with it, spindle 12, gear 13, and motor 14, to raise relative to apron 6. Movement of the shaft, in turn, moves hook ends 11, positively guided by guide slots 9 and stationary guide pins 10, out of the extending hook 4 permitting the cover 1 to be opened. To return the lock to the functional position for automatic operation following the manual unlocking procedure, spindle 12 is driven upward by motor 14 and gear 13. Because the guide slots 9 are supported on stationary guide pins 10, gear 13, along with motor 14, is pressed downward. Since lever 17 is biased downwardly by spring 18, the lever 17 is also pulled downward to latch in detent pawl 19 thereby effecting a return to operating condition of the locking device.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A locking device for locking a first component to a second component, the locking device comprising:

(a) a stop configured for projecting from the first component and being disposed in a plane of symmetry;

(b) a pair of catches configured for being disposed on the second component, the pair of catches each being rotatably mounted to a shaft and having a free hook end, the pair of catches being movable between a first position when the shaft is raised and a second position when the shaft is lowered, in the first position the hook ends are separated and inwardly face on opposing sides of the plane of symmetry, in the second position the hook ends are rotated inwardly so as to secure the stop therebetween;

(c) means for guiding the rotational movement of each of the pair of catches;

(d) a elongated rigid spindle projecting from the shaft;

(e) a motor engaging the spindle to facilitate selective displacement of the spindle; and (f) means for enabling manual emergency unlatching of the stop from the pair of catches without disengaging the motor from the spindle comprising:

(i) a rotatable lever configured for attachment to the second component the rotatable lever operable between a first position wherein the rotatable lever secure the motor stationary relative to the spindle and a second position wherein the motor is free to move with the spindle, (ii) a rotatable detent pawl configured for attachment to the second component the detent pawl securing the lever in the first position; and (iii) means for manually separating the detent pawl from the lever.

2. The locking device described in claim 1 wherein the step is configured as an extending hook with a closed end.

3. The locking device described in claim 1 wherein the stop is configured as an extending hook with an open end closed with a locking pin.

4. The locking device described in claim 1 wherein the pair of catches arc plate-shaped and arc disposed perpendicular to the plane of symmetry.

5. The locking device described in claim 1 wherein the catches are mechanically locked in the second position so as to prevent unwanted manual separation of the catches by prying therebetween.

6. The locking device described in claim 1 wherein the hook ends are arranged in planes one behind the other with respect to the plane of symmetry.

7. The locking device described in claim 1 wherein the hook ends rest in frictional connection against the stop when the catches arc in the second position.

8. The locking device described in claim 1 further comprising a position indicator adapted to indicate the position of the pair of catches.

9. A locking device described in claim 1, wherein the means for guiding the rotational movement of each of the pair of catches comprises a guide pin and guide slot associated with each of the pair of catches, each guide slot configured for on one of a select catch or second component and each guide pin being configured for formation on the other of the select catch or second component, each guide pill being, partially received within the corresponding guide slot so as to direct movement of the select catch between the first position and the second position.

10. The locking device described in claim 1 wherein the spindle engages a gear connected to the motor.

11. A locking device as recited in claim 1, wherein the means for manually separating the detent pawl from the lever comprises a release cord connected to the detent pawl.

* * * * *

UNITED STATES PATENT AND TRADEMARK OFFICE

CERTIFICATE OF CORRECTION

PATENT NO. : 5,915,766

DATED : Jun. 29, 1999

INVENTOR(S) : Baumeister et al.

It is certified that error appears in the above-identified patent and that said Letters Patent is hereby corrected as shown below:

Col. 6, line 67, after "(d)" change "a" to --an--

Col. 7, line 7, after "component" insert a comma

Col. 7, line 9, before "the motor" change "secure" to --secures--

Col. 7, line 23, after "catches" and "and" change "arc" to --are--

Col. 8, line 6, after "catches" change "arc" to --are--

Col. 8, line 18, before " , partially" change "pill being," to --pin being--

Signed and Sealed this

Twenty-fifth Day of April, 2000

*Attest:*

*Attesting Officer*

Q. TODD DICKINSON

*Director of Patents and Trademarks*